US007422168B2

(12) United States Patent
Jung et al.

(10) Patent No.: US 7,422,168 B2
(45) Date of Patent: Sep. 9, 2008

(54) ICE BIN OF REFRIGERATOR

(75) Inventors: Eui-Yeop Jung, Seoul (KR); Sung-Hoon Chung, Seoul (KR); Nam-Gi Lee, Seoul (KR); Wook-Yong Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 4 days.

(21) Appl. No.: 11/359,476

(22) Filed: Feb. 23, 2006

(65) Prior Publication Data

US 2006/0202071 A1 Sep. 14, 2006

(30) Foreign Application Priority Data

Mar. 11, 2005 (KR) ..... 10-2005-0020732

(51) Int. Cl.
*B02B 1/08* (2006.01)
*F25C 5/02* (2006.01)

(52) U.S. Cl. ..... 241/65; 241/DIG. 17; 62/320

(58) Field of Classification Search ..... 241/65, 241/101.2, DIG. 17; 62/157, 344, 320
See application file for complete search history.

(56) References Cited

U.S. PATENT DOCUMENTS

| | | | | |
|---|---|---|---|---|
| 2,588,741 | A | | 3/1952 | Toothed |
| 2,643,065 | A | * | 6/1953 | Clawson ..... 241/239 |
| 3,843,067 | A | | 10/1974 | Prada |
| 5,148,996 | A | | 9/1992 | Fletcher et al. |
| 5,947,342 | A | | 9/1999 | Song |
| 2004/0237563 | A1 | | 12/2004 | Lee et al. |
| 2004/0237569 | A1 | | 12/2004 | Lee et al. |
| 2004/0261442 | A1 | | 12/2004 | Chung et al. |
| 2005/0056043 | A1 | | 3/2005 | Lee et al. |
| 2005/0066670 | A1 | | 3/2005 | Chung et al. |
| 2006/0144976 | A1 | | 7/2006 | Lee et al. |

FOREIGN PATENT DOCUMENTS

| | | |
|---|---|---|
| EP | 1482261 | 12/2004 |
| EP | 1482262 | 12/2004 |
| EP | 1491833 | 12/2004 |
| KR | 10-0276738 | 5/2000 |

OTHER PUBLICATIONS

English language Abstract of Korean 10-0276738.

* cited by examiner

*Primary Examiner*—Faye Francis
(74) *Attorney, Agent, or Firm*—Greenblum & Bernstein, P.L.C.

(57) ABSTRACT

An ice dispenser apparatus includes an ice bin to receive ice cubes; a shutter mechanism located near a bottom of the ice bin to selectively dispense ice cubes or crushed ice; an ice crusher located above the shutter mechanism to crush ice cubes into crushed ice; and an ice discharge controller located adjacent to the ice crusher and having a structure to selectively provide a certain amount of ice cubes onto the shutter mechanism and to effectively minimize an undesirable accumulation of ice near the ice crusher that may cause interference during operation.

7 Claims, 5 Drawing Sheets

ICE BIN OF REFRIGERATOR

BACKGROUND OF THE INVENTION

1. Field of the Invention

The present invention relates to an ice bin of a refrigerator, and more particularly, to an ice bin of a refrigerator for preventing a phenomenon that rotary motion of a rotating blade is restricted by excessive ejecting of whole ice to the outside of the ice bin and being stacked of piece of ice to the bottom of the ice bin.

2. Description of the Related Art

FIG. 1 is a schematic view that roughly illustrates the structure of a related art refrigerator, and FIG. 2 is a cross-sectional view of the structure of an ice bin of FIG. 1.

As illustrated in these drawings, in general, a refrigerator comprises a water tank 10 that is attached to the refrigerator body for keeping a certain amount of water therein, an ice machine 30 connecting to double solenoid valve 20 which is interposed at a first outlet 11 of the water tank 10 and including an ice making mold 31 that is used to make ice, an ice bin 40 that is connected to the ice making mold 31 for storing the made ice and grinding the stored ice prior to dispensing, and a dispenser 50 that externally discharges the ice from the ice bin 40 through an outlet thereof, and further externally discharges the water stored in the water tank 10 through a second outlet 12 thereof.

The double solenoid valve 20 comprises an ice making valve (not shown) and a dispenser valve (not shown). As mentioned above, the ice making valve supplies water to the ice making mold 31 by opening the valve when ice making is necessary, and the dispenser valve discharges the supplied water to the dispenser 50 by lowering the temperature of the supplied water upon passing through the water tank 10 and opening it according to the user's need.

The ice bin 40 comprises a case 41 with an upper portion that is open (or can be opened) to allow a flow of ice (e.g., ice cubes, pieces of ice, etc.) to enter and has a diffuser 41*a* at a bottom portion thereof used for externally discharging the ice; an auger 44 positioned within the case 41 for transferring the flow of ice; guides 42*a*, 42*b* for guiding the transferred ice; a grinder 43 for grinding the ice guided by guides 42*a*, 42*b*; and a shutter 45 that opens and closes the diffuser 41*a* for selectively discharging the ice from the case 41.

One part of the case 41 is formed to be rectangular, and the grinder 43 is located at the center of the bottom of the case 41. The guides 42*a*, 42*b* are inclined "downward" towards the grinder 43 (positioned at the center of the case 41) and formed to be extended from both side sections of the case 41. The grinder 43 and the guides 42*a*, 42*b* are arranged at a fixed distance (namely, there is a gap therebetween) to allow the ice cubes to be ground up as they fall into the grinder 43.

The grinder 43 comprises a rotating blade 43*a* having the same axis with the auger 44, and a fixed blade 43*b* being fixed and arranged in a perpendicular manner (at a right angle) with the bottom surface of the case 41, and wherein multiple blade portions 43*c* that are curved inwardly (as shown in FIGS. 2 and 3) are provided along the length of each rotating blade 43*a* and provided on the fixed blade 43*b*, such that ice may be ground therebetween.

As can be understood from FIG. 2, the guides 42*a*, 42*b* comprise a first guide 42*a* which is inclined downward from one side section of the case 41 to the grinder 43, and is formed by being extended to a distance from the grinder 43 and a second guide 42*b* which is inclined downward from the an opposing side section facing of the case 41 to the grinder 43 and is formed by extending to an adjacent location from the fixed blade 43*b*.

Referring to FIG. 2, the shutter 45 has a fixed length and is formed to have a curved portion according to a radius of rotation of the rotating blade 43*a*. The shutter 45 has one end being hinge-engaged adjacent to the first guide 42*a* to allow rotation towards the bottom of the case 41 in order to selectively open and close the diffuser 41*a*, and has another end that selectively contacts with the second guide 42*b* when the diffuser 41*a* is closed to prevent ice being discharged from the ice bin 40.

The bottom of the shutter 45 includes a coupling member 47 having certain dimensions and a coupling hole 47*a* formed therethrough, and one end of a control lever 46 which upwardly supports the shutter 45 is coupled in the coupling hole 47*a* to allow the shutter 45 to be opened or closed, and to maintain the closed state of the diffuser 41*a*. The other end of the control lever 46 is inserted into a joint 48 that is securely attached to the case 41 and acts as the axis of rotation for the control lever 46 as shown in FIGS. 2 and 3.

In accordance with the related art structure, the ice sent into the ice bin 40 through the open upper potion thereof, is transferred to the grinder 43 by a spiral type auger 44 that rotates upon receiving power from a motor (not shown). Pieces of ice fall between the curved blade portions 43*c* of the rotating blade 43*a* (that rotates on the same axis as the auger 44) and the curved blade portions 43*c* of the fixed blade 43*b* that is fixed to the case 41, and the ice is thus ground (crushed) by the rotating power of the rotating blade 43*a*. Thereafter, a mode change operation causes the shutter 45 to open and the grinded ice is discharged through the diffuser 41*a*.

If the user desires ice that is not grinded, the above mode change operation is omitted, and the shutter 45 opens such that relatively large pieces of ice cubes (that have not been grinded) are discharged through the diffuser 41*a*.

However, in such an ice bin of the related art refrigerator, there are problems in that when the shutter 45 is opened to discharge ice cubes from the ice bin 40, too many ice cubes may be discharged all at once. Also, the ice cubes hitting the hard surfaces of the ice bin 40 and other components may break up undesirably.

Moreover, there are problems in that the pieces of ice that were not completely grinded (during previous grinding operations over prolonged use) are undesirably accumulated at the bottom of the ice bin 40, which interfere with the rotary motion of the rotating blade 43*a* to cause improper grinding, unnecessary ware-and-tear on the rotating blade and fixed blade, and damage to various other components.

BRIEF DESCRIPTION OF THE INVENTION

The present invention provides an ice bin of refrigerator comprising a case having an opened upper potion to receive ice therein and has a diffuser at a bottom portion thereof for externally discharging ice; an auger within the case for transferring the ice; guides for guiding the transferred ice; a grinder for grinding the guided ice; a shutter that opens and closes the diffuser in order to selectively discharge ice; and an ice discharge controller capable of controlling the amount of discharged ice.

The present invention advantageously controls the amount of ice cubes being discharged, minimizes the undesirable break up of ice cubes, minimizes undesired accumulation of ice pieces at the bottom of the ice bin to thus reduce interference with the rotary motion of the rotating blade, minimizes improper grinding, minimizes unnecessary wear-and-tear on the rotating blade and fixed blade, and minimizes damage to various other components.

BRIEF DESCRIPTION OF THE INVENTION

DETAILED DESCRIPTION OF THE INVENTION

Hereinafter, the present invention is to be described in detail referring to the attached drawings.

One aspect of the present invention is that the present inventors recognized the drawbacks of the related art. Namely, an undesirably large amount of ice cubes may be discharged, the ice cubes may break up undesirably while being discharged, undesired accumulation of ice pieces at the bottom of the ice bin interferes with the rotary motion of the rotating blade, causes improper grinding, causes unnecessary wear-and-tear on the rotating blade and fixed blade, and causes damage to various other components.

Figure 3:
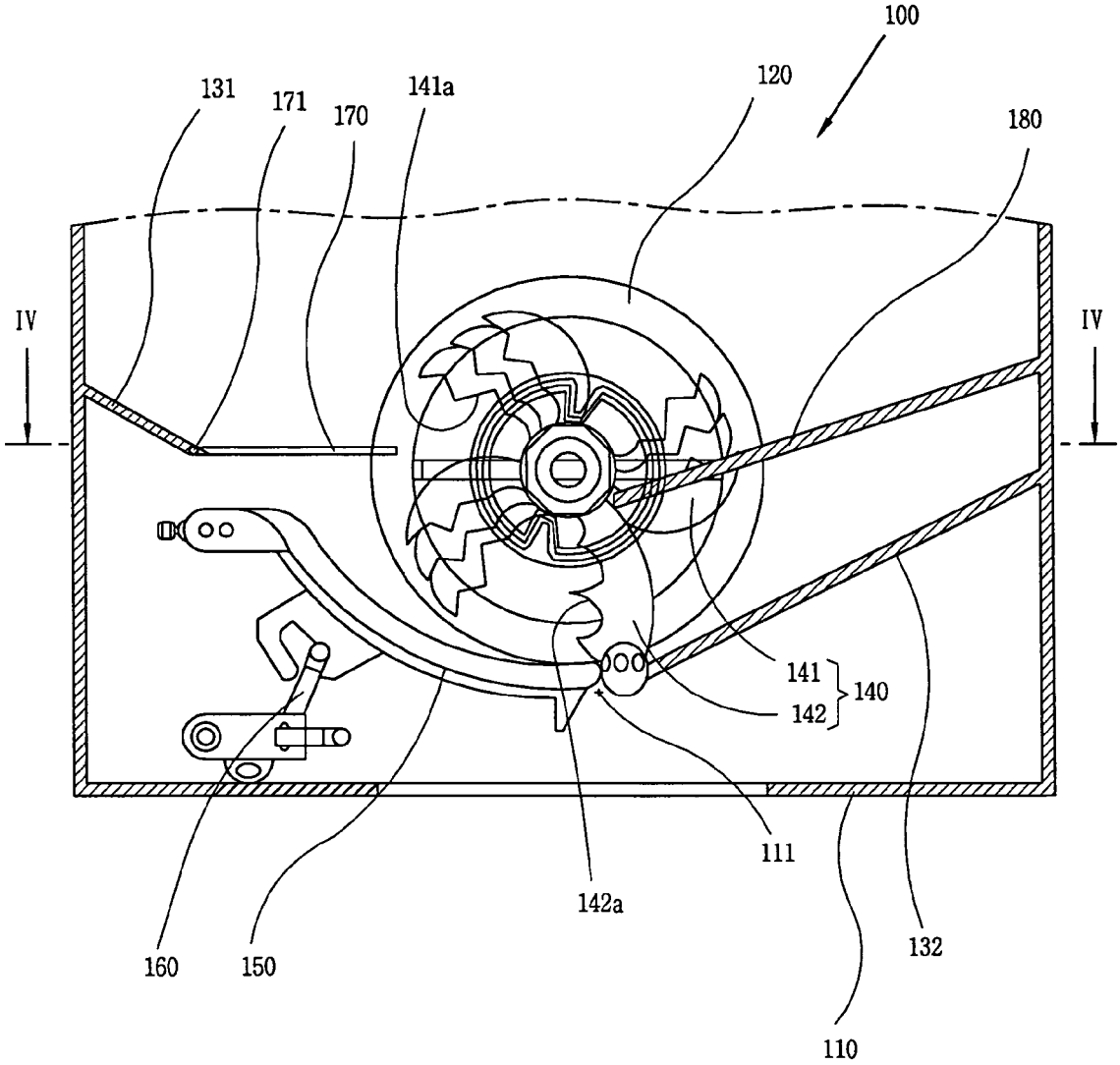
FIG. 3 is a cross-sectional view that illustrates the structure of an exemplary ice bin of a refrigerator according to one embodiment of the present invention.
Figure 4:
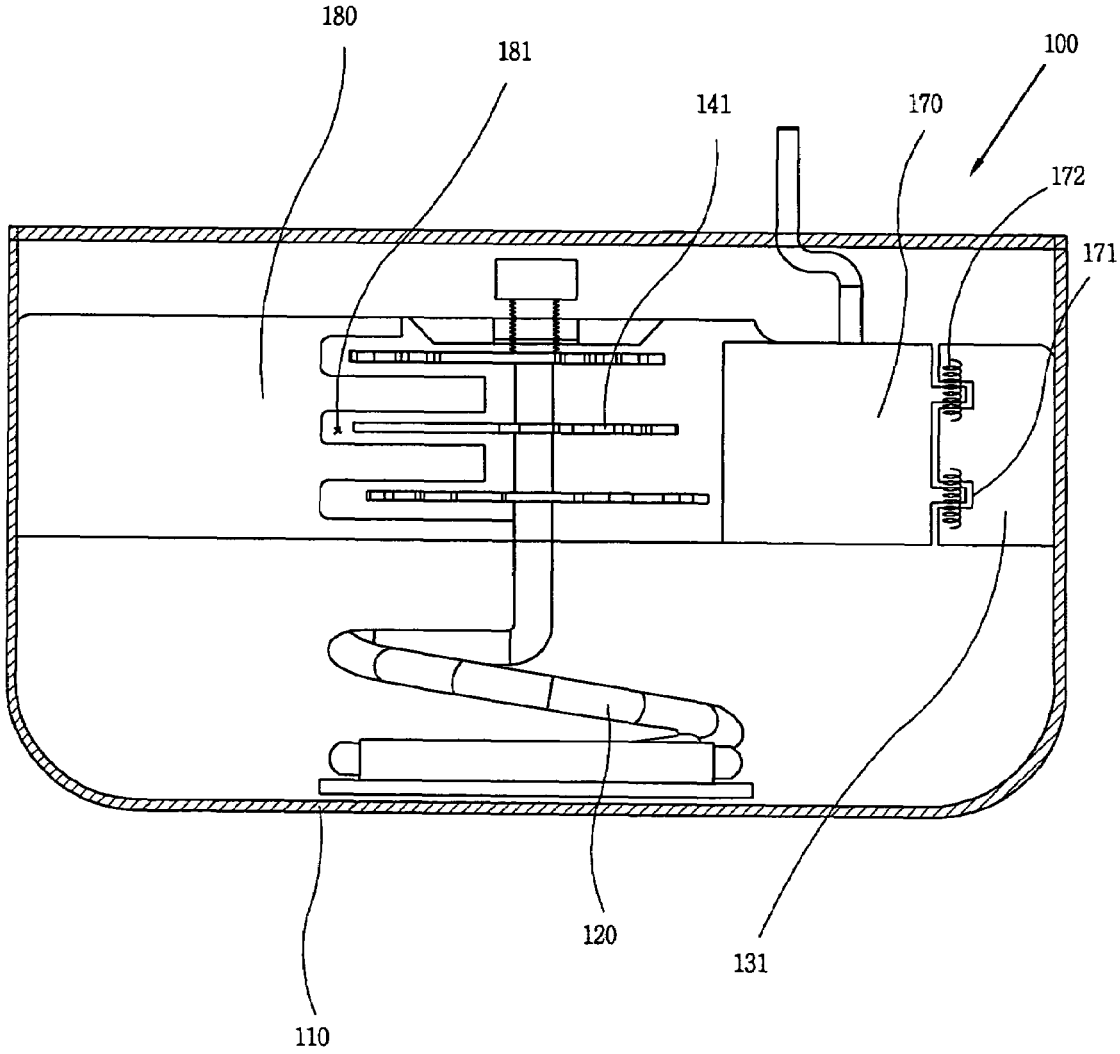
FIG. 4 is a line cross-sectional view according to line 'IV-IV' of FIG. 3.
Figure 5:
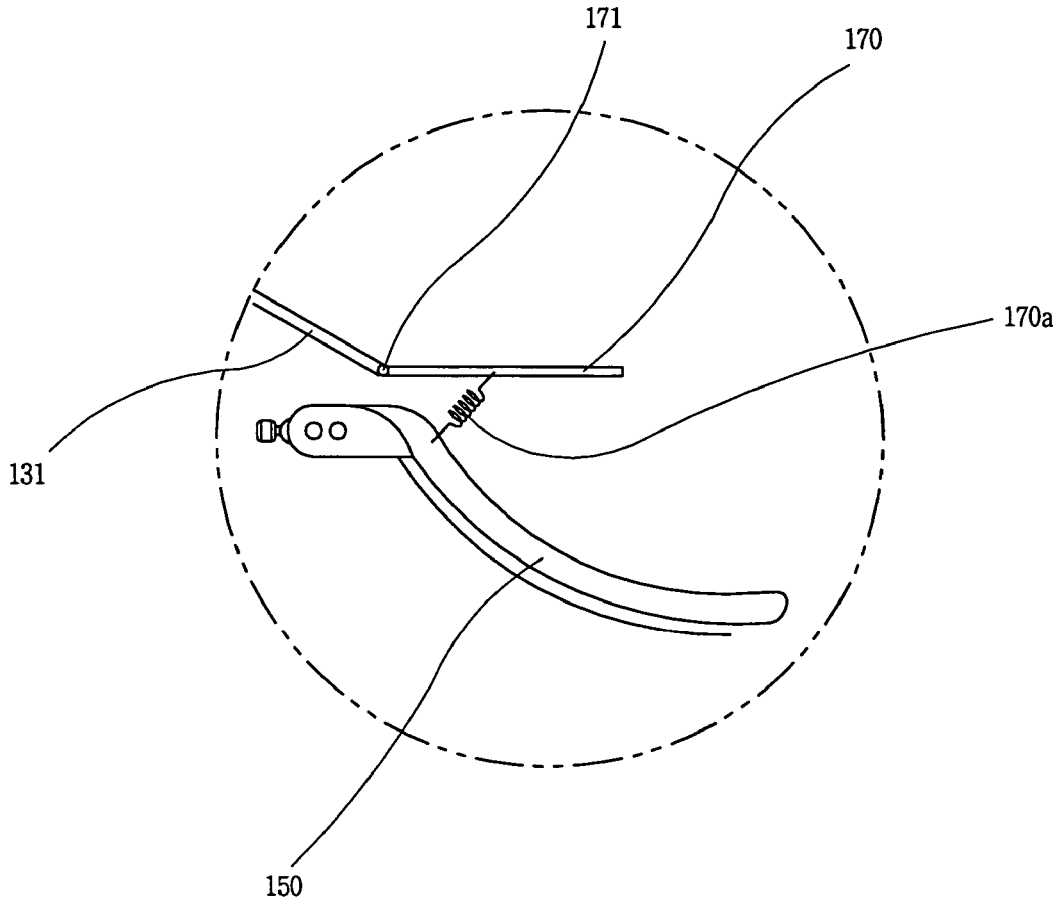
FIG. 5 is a structure of a flap and a shutter according to the other exemplary embodiment of the present invention.

FIG. 3 is a cross-sectional view that illustrates the structure of an exemplary ice bin of a refrigerator according to one embodiment of the present invention, and FIG. 4 is a line cross-sectional view according to line 'IV-IV' of FIG. 3, and FIG. 5 is a structure of a flap and a shutter according to another exemplary embodiment of the present invention.

As illustrated in the above-mentioned drawings, the ice bin of a refrigerator for one embodiment of the present invention comprises, a case 110 having an opened (exposed) upper potion (or may be opened and closed) to receive ice (e.g., ice cubes, ice chips, etc.) therein and has a diffuser 111 (or disperser) at a bottom portion thereof for externally discharging ice; an auger 120 (or gimlet) within the case for transferring the ice; guides 131, 132 for guiding the transferred ice; a grinder 140 (or crusher) for grinding (crushing) the ice guided by the guides 131, 132; a shutter 150 (or other type of flap member) that opens and closes the diffuser in order to selectively discharge ice; and an ice discharge controller (170, 180) capable of controlling the amount of discharged ice.

A cross section of the case 110 may be a rectangular shape, and a grinder 140 may be mounted at or near the bottom center of the case 110. The guides 131, 132 are inclined "downward" toward the grinder 140 as extensions from opposing internal (side) walls of the case 110, and the grinder 140 and the guides 131, 132 are arranged to have a certain gap therebetween, to allow space for grinding (crushing) the ice that drops or down falls into the grinder 140.

The grinder 140 may comprise: a rotating blade 141 which is rotated on the same axis with the auger 120; a fixed blade 142 which is fixed and arranged at a relatively perpendicular manner (at a right angle) with the bottom surface of the case 110; and multiple blades with inwardly curved portions formed along the length (or wing) of each rotating blade 141 and fixed blade 142 for grinding (crushing) the ice.

The guides 131, 132, may comprise: a first guide 131 which is inclined "downward" from one side of the case 110 extending towards the grinder 140; and a second guide 132 which is inclined "downward" from the opposing side of the case 110 extending towards the grinder 140 and an end portion of the second guide 132 is adjacent to or connected with the fixed blade 142.

A shutter 150 may be formed to have a curvature of certain length according to a radius of rotation of the rotating blade 141. One side thereof may be hinge-engaged near to the first guide 131 to allow the shutter 150 to selectively open and close the diffuser 111. The second end of the shutter 150 (which opposes the first end) operatively contacts with an end of the second guide 132, when the diffuser 111 is closed to prevent ice from discharging.

A control lever 160 operatively mounted within the case 110 may have one end operatively connected with the bottom of the shutter 150. The control lever 160 allows the shutter 150 to be opened and closed, while upwardly supporting the shutter 150 for selectively maintaining the closed state of the diffuser 111.

An ice discharge controller may be comprised of at least a flap 170 (or similar element) and a grill 180 (or a similar element), as shown in FIGS. 3 to 5.

Figure 1:
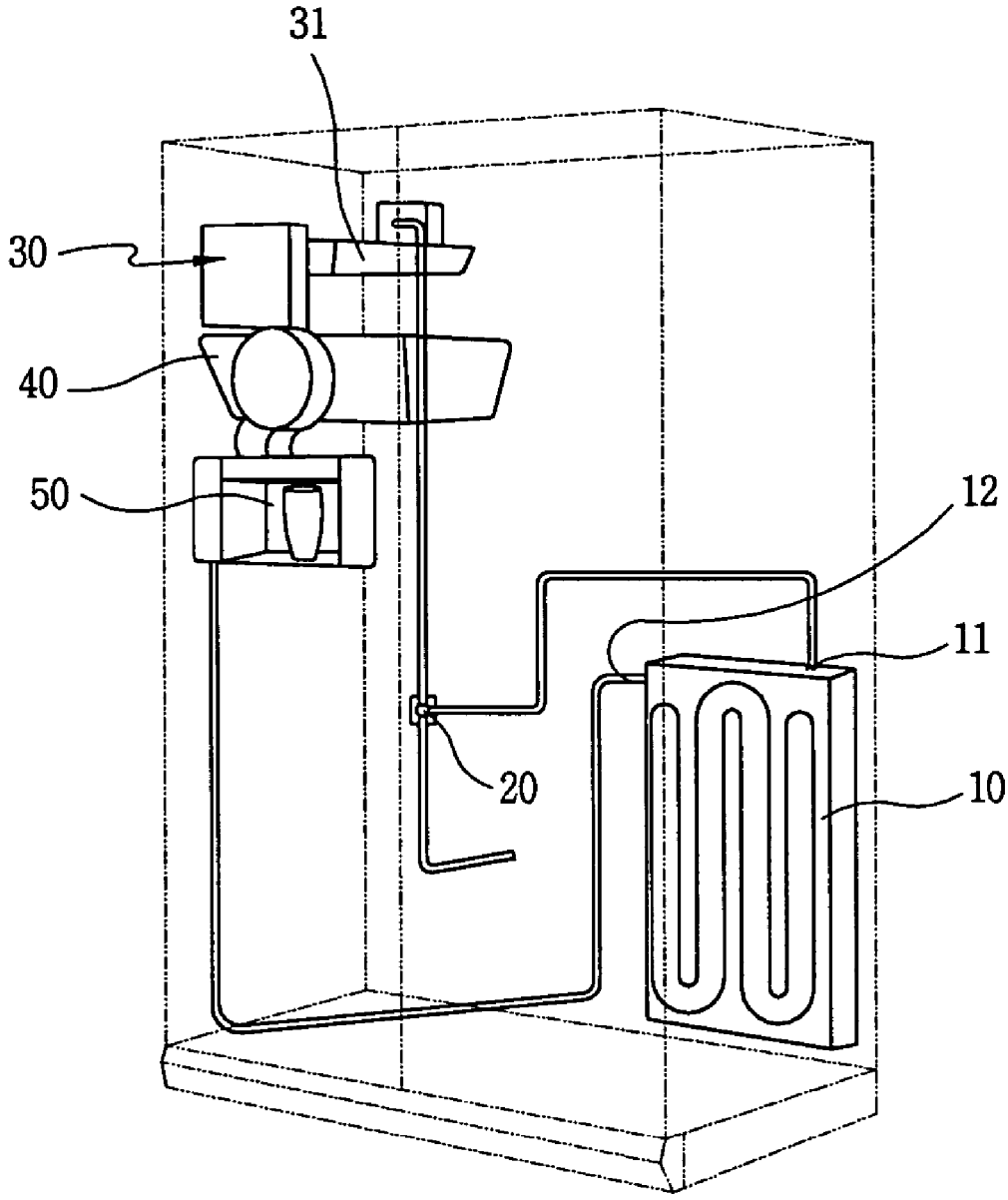
FIG. 1 CONVENTIONAL ART
FIG. 1 is a schematic view that generally illustrates a structure of the conventional refrigerator.
Figure 2:
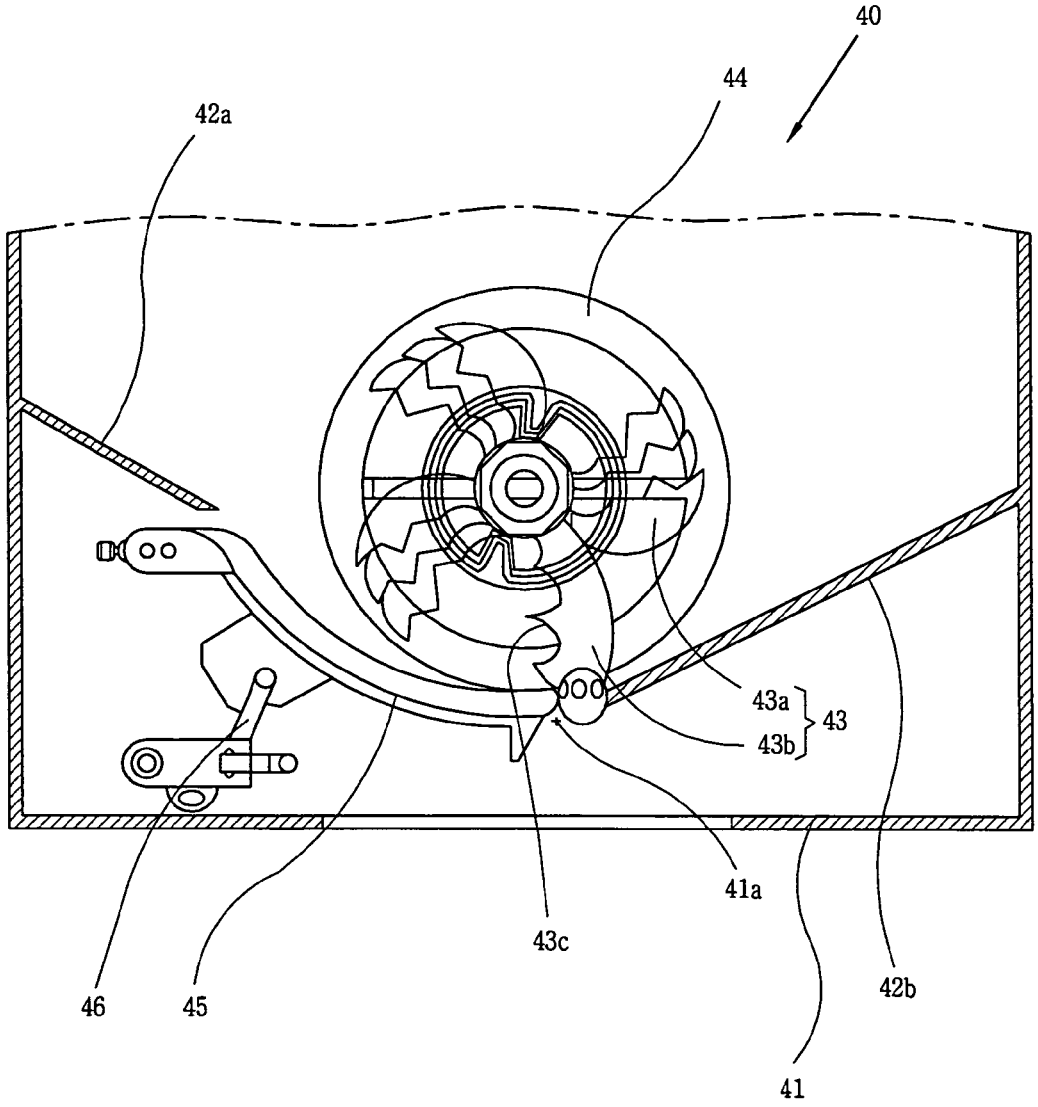
FIG. 2 CONVENTIONAL ART
FIG. 2 is a cross-sectional view that illustrates the structure of an ice bin of FIG. 1.

Referring back to FIG. 2, the related art structure causes undesirable accumulation of ice (i.e., ice pieces, ice chips, etc. due to grinding) at an area around and between the first guide 42*a* and the shutter 45, because the first guide 42*a* extends directly down to the shutter 45.

However, in the present invention FIGS. 3 to 5, the flap 170 may be attached to (or formed as an extension of) an end of the first guide 131. The flap 170 may extend towards the grinder 140 at an appropriate length without interfering with the rotating blade 141 operation. Namely, the flap 170 prevents the first guide 131 to extend directly down to the shutter 150. As such, undesirable accumulation of ice at an area around and between the first guide 131 and the shutter 150 can be minimized. Also, because the flap 170 is "flexible" with respect to the first guide 131, a certain amount of ice cubes on the flap 170 will cause the flap 170 the open to let the ice cubes drop down toward the shutter 150.

The "flexibility" of the flap 170 may be achieved by having an elastic hinge connection with one end of the first guide 131. To do so, a hinge part 171 at one end of the first guide 131 can be provided to allow the flap 170 to flip up and down.

Also, the elastic movement of the flap 170 may be achieved by a twisted spring 172 installed at the hinge part 171. Alternatively, the flap 170 itself may be made of a flexible material.

The grill 180 may be located within the case 110 above the second guide 132 to prevent ice pieces from accumulating on the second guide 132 due to the grinding performed by the grinder 140. The grill 180 may be formed as an extension of an inner side-wall of the case 110, and projects toward the fixed blade 142, preferably in a "downward" direction. Here, an end of the grill 180 may be operatively connected with the fixed blade 142 itself or may be attached adjacent thereto.

As shown in FIG. 4, the grill 180 may have slotted openings 181 (or slits) formed along an edge thereof to allow the rotating blade 141 with its one or more blade wheels to pass by during operation. The extensions (or arms) between the slotted openings may further to prevent ice pieces from accumulating on the second guide 132. The grill 180 may have additional openings to allow ice cubes of a certain size to pass through. In other words, the grill 180 may have an overall "grill-like" or screen-like" shape or may be made of a solid plate member without any through holes.

The flap 170 and grill 180 also function to prevent ice cubes received into the ice bin 100 from directly hitting various components therein (namely, the walls of the case 100, the second guide unit 132, the shutter 150, etc.) to thus minimize any undesirable breaking up of the ice cubes. Namely, the flap 170 and grill 180 provide a cushion for the ice cubes that fall into the ice bin 100 from the ice maker located above.

In accordance with such construction, the ice cubes received in the ice bin 100 through its open (or exposed) upper potion (or an upper portion that may be opened and closed), is transferred to the grinder 140 by the spiral type auger 120 that is rotated by a motor (not shown). The transferred ice falls between the rotating blade 141 (that is rotated on the same axis with the auger 120) and the fixed blade 142 mounted within the case 110, and is grinded therebetween. Thereafter, if the shutter 150 is opened by mode change operation, the ground ice can be dispensed through the diffuser 111.

As the rotating blade 141 operates to grind the ice cubes, smaller ice chips or pieces may break off, spatter, or even bounce off the walls of the case 110. Such ice chips and pieces accumulate on the second guide 42*b* of the related art structure during prolonged use. However, in the present invention, the grill 180 (located above the second guide 132) may effectively catch many of these ice chips and pieces such that less ice accumulates on the second guide 132.

If the user desires to get relatively large sized ice cubes, the ice grinding operation is not performed. The ice bin 100 merely receives a certain amount of ice cubes. These ice cubes accumulate on the flap 170, and when the total weight of numerous ice cubes is greater than the resilient force of the twisted spring 172 (or the flap 170 made of flexible material can no longer bear the ice cube load), some or most of these ice cubes then drop onto the shutter 150 below, which can then be opened to discharge the relatively large sized ice cubes through the diffuser 111 opening to the user. Thereafter, because a less amount of ice cubes (or no ice cubes) remain on top of the flap 170, the flap 170 may then return to its initial position due to the elasticity of the twisted spring 172 (or due to the flexible material of the flap 170 itself). If the user desires to receive additional large sized ice cubes, the above procedures are repeated. As such, large ice cubes may be discharged in a controlled manner in appropriate amounts, and the flap 170 may effectively minimize ice cube breakage during this process.

FIG. 5 is a cross-sectional view of the structure of the flap and the shutter according to another embodiment of the present invention The detailed description with respect to certain elements that are common with the previously described first embodiment will be omitted merely for the sake of brevity.

In this additional embodiment, the flap 170 may be hinge-engaged with one end of the first guide 171 to allow pivoting thereof, and an extension spring 170*a* may connect the flap 170 with shutter 150. In accordance with such structure, when the user discharges large ice cubes, if the weight of the ice cubes on top of the flap 170 is greater than the resilient power of the compressed spring 170*a*, the flap 170 opens to let the ice cubes fall through. The flap 170 will return to its original position if the load of ice cubes on the flap 170 can again be supported by the compressed spring 170*a* after some (or all) ice cubes were dropped down to the shutter 150.

The present invention provides an ice dispenser apparatus, comprising: an ice bin to receive ice cubes; a shutter mechanism located near a bottom of the ice bin to selectively dispense ice cubes or crushed ice; an ice crusher located above the shutter mechanism to crush ice cubes into crushed ice; and an ice discharge controller located adjacent to the ice crusher and having a structure to selectively provide a certain amount of ice cubes onto the shutter mechanism and to effectively minimize an undesirable accumulation of ice near the ice crusher that may cause interference during operation.

The ice discharge controller may comprise a plate member operatively mounted to a first side wall in the ice bin, above the shutter mechanism and extending towards but not interfering with the ice crusher. The plate member may be operatively mounted via a spring mechanism allowing a certain amount of ice cubes to be released from the plate member when the spring mechanism can no longer bear the weight of ice cubes collected on the plate member. The plate member may be operatively mounted via a hinge connector and a spring that connects a bottom of the plate member with the shutter therebelow, allowing a certain amount of ice cubes to be released from the plate member when the spring mechanism can no longer bear the weight of ice cubes collected on the plate member. The plate member itself is made of a flexible material allowing a certain amount of ice cubes to be released from the plate member when the spring mechanism can no longer bear the weight of ice cubes collected on the plate member.

The ice discharge controller may further comprise a grill member mounted to a second side wall in the ice bin and extending towards but not interfering with the ice crusher. The grill member may have slotted openings along an edge thereof to allow rotating blades of the ice crusher to pass by the grill member.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. An ice bin of a refrigerator, comprising:

a case which opens an upper surface to flow ice cubes into an inside and has a diffuser at one side of a bottom to eject the ice cubes to the outside;

an auger installed at the inside of the case to transfer the flowed ice cubes;

guides that guide the transferred ice cubes;

a grinder that grinds the ice cubes guided by said guide;

a shutter that opens and closes said diffuser to selectively eject the ice cubes to the outside of said case; and an ice ejecting control configured to control the amount of ice cubes ejected to the outside of said case, wherein said guide comprises:

a first guide that is inclined downward from one side surface of said case toward the grinder and is separated by a certain distance from said grinder;

a second guide that is inclined downward from a second side surface facing the one side surface of said case toward said grinder and extending to a location adjacent to said fixed blade; and said ice ejecting control is a flap that extends from one part of the first guide to a location adjacent to a rotating trace of the grinder and is configured to selectively eject the ice cubes that accumulate at a bottom of said ice ejecting control by the amount of the stacked ice cubes.

2. The ice bin of claim 1, wherein said grinder comprises:

a fixed blade fixed and arranged at a generally right angle to the bottom of said case; and a rotating blade arranged to be rotated by connecting to said auger.

3. The ice bin of claim 1, wherein said flap is hinged to one end of the first guide by forming a hinge at one end of the first guide to perform elastic rotary motion about one end of the first guide as a center, and a coiled spring is installed at the hinge.

4. The ice bin of claim 1, wherein the flap is hinged to one end of the first guide to be capable of rotating about one end of the first guide as a center by forming the hinge at one end of said first guide, and an extension spring is installed between one side of the bottom surface of the flap and one side of the upper surface of the shutter.

5. The ice bin of claim 1, wherein a grill that prevents ground ice from spattering or bouncing off the walls of the case is further installed at the upper surface of said second guide.

6. The ice bin of claim 5, wherein the grill is arranged and separated by a distance from said second guide at the upper side of said second guide in a height direction of said case and extends from the inner wall of said case toward said fixing blade.

7. The ice bin of claim 6, wherein openings are formed in said grill to permit said rotating blade to pass during operation.

* * * * *